US008544974B2

(12) United States Patent
Boot et al.

(10) Patent No.: US 8,544,974 B2
(45) Date of Patent: Oct. 1, 2013

(54) DROPLET SELECTION MECHANISM

(75) Inventors: Ronaldus Jacobus Johannes Boot, Son en Breugel (NL); René Jos Houben, Nederweert (NL); Gerrit Oosterhuis, Best (NL); Antonius Paulus Aulbers, Eindhoven (NL)

(73) Assignee: Nederlandse Organisatie voor toegepast-natuurwetenschappelijk onderzoek TNO (NL)

( * ) Notice: Subject to any disclaimer, the term of this patent is extended or adjusted under 35 U.S.C. 154(b) by 273 days.

(21) Appl. No.: 12/742,236

(22) PCT Filed: Nov. 10, 2008

(86) PCT No.: PCT/NL2008/050715

§ 371 (c)(1),
(2), (4) Date: Mar. 28, 2011

(87) PCT Pub. No.: WO2009/061201

PCT Pub. Date: May 14, 2009

(65) Prior Publication Data

US 2011/0187778 A1 Aug. 4, 2011

(30) Foreign Application Priority Data

Nov. 9, 2007 (EP) ..... 07120332

(51) Int. Cl.
*B41J 29/38* (2006.01)
*B41J 2/02* (2006.01)

(52) U.S. Cl.
USPC ..... 347/9; 347/14; 347/75

(58) Field of Classification Search
USPC ..... 347/9, 14, 75
See application file for complete search history.

(56) References Cited

U.S. PATENT DOCUMENTS

| | | | | |
|---|---|---|---|---|
| 3,709,432 | A | 1/1973 | Robertson | |
| 3,958,249 | A | 5/1976 | DeMaine et al. | |
| 4,190,844 | A | 2/1980 | Taylor | |
| 4,341,310 | A * | 7/1982 | Sangiovanni et al. | 209/638 |
| 4,914,522 | A | 4/1990 | Duffield et al. | |
| 5,838,350 | A * | 11/1998 | Newcombe et al. | 347/68 |

(Continued)

FOREIGN PATENT DOCUMENTS

| | | |
|---|---|---|
| CN | 1266783 | 9/2000 |
| CN | 101048283 | 10/2007 |

(Continued)

OTHER PUBLICATIONS

International Search Report issued in PCT/NL2008/050715 dated Feb. 4, 2009.

*Primary Examiner* — Jason Uhlenhake
(74) *Attorney, Agent, or Firm* — Knobbe Martens Olson & Bear, LLP

(57) ABSTRACT

A method and droplet selection device are provided for a continuous printer for selectively ejecting a second droplet and to have it collided with a predefined first droplet. In particular, the device comprises a first droplet ejection system arranged to generate a continuous stream of first droplets from a fluid jetted out of an outlet channel; and a second droplet ejection system arranged to generate second droplets for colliding the second droplets into the first droplets so as to selectively deflect the first droplets from a predefined printing trajectory. The second droplet ejection system comprises a control circuit to selectively eject the second droplet and to have it collided with a predefined first droplet.

19 Claims, 3 Drawing Sheets

(56) References Cited

U.S. PATENT DOCUMENTS

| | | | | |
|---|---|---|---|---|
| 5,907,338 | A * | 5/1999 | Burr et al. | 347/43 |
| 6,200,013 | B1 | 3/2001 | Takeuchi et al. | |
| 6,291,927 | B1 | 9/2001 | Percin et al. | |
| 6,299,288 | B1 | 10/2001 | Abeywardane et al. | |
| 6,357,866 | B1 | 3/2002 | van Rensburg | |
| 6,505,920 | B1 | 1/2003 | Braun | |
| 2007/0279467 | A1 * | 12/2007 | Regan et al. | 347/100 |
| 2007/0296773 | A1 * | 12/2007 | Sharma et al. | 347/75 |

FOREIGN PATENT DOCUMENTS

| | | | |
|---|---|---|---|
| EP | 0 011 170 | A | 5/1980 |
| EP | 0 422 616 | A | 4/1991 |
| EP | 0 943 436 | A | 9/1999 |
| EP | 1 219 431 | A | 7/2002 |
| EP | 1 228 874 | A | 8/2002 |
| EP | 1 398 155 | A | 3/2004 |
| EP | 1 637 329 | A | 3/2006 |
| GB | 1 521 874 | A | 8/1978 |
| GB | 2 041 831 | A | 9/1980 |
| GB | 1 598 779 | A | 9/1981 |
| JP | 50-51631 | A | 5/1975 |
| JP | 53134434 | A | 11/1978 |
| JP | 3101365 | A | 4/1991 |
| JP | 5185635 | A | 7/1993 |
| JP | 5-229126 | A | 9/1993 |
| JP | 07-314665 | A | 5/1995 |
| JP | 8258271 | A | 10/1996 |
| JP | 2005-254579 | A | 9/2005 |
| WO | 2004/011154 | A2 | 2/2004 |
| WO | 2006/038979 | A1 | 4/2006 |
| WO | WO 2006/101386 | A | 9/2006 |

* cited by examiner

Droplets merging :

Droplets bouncing:

DROPLET SELECTION MECHANISM

This application is the U.S. National Phase of International Application No. PCT/NL2008/050715, filed Nov. 10, 2008, designating the U.S. and published in English as WO 2009/061201 on May 14, 2009 which claims the benefit of European Patent Application No. 07120332.7 filed Nov. 9, 2007.

FIELD OF THE INVENTION

The invention relates to a droplet selection device for a continuous printing system. In this connection, by a continuous jet printing technique is meant the continuous generation of drops which can be utilized selectively for the purpose of a predetermined printing process. The supply of drops takes place continuously, in contrast to the so-called drop-on-demand technique whereby drops are generated according to the predetermined printing process.

BACKGROUND OF THE INVENTION

A known apparatus is described, for instance, in U.S. Pat. No. 4,341,310. This document discloses a so-called continuous jet printer for printing materials using a first droplet ejection system arranged to generate a continuous stream of first droplets from a fluid jetted out of an outlet channel. During the exit of the fluid through an outlet channel, a pressure regulating mechanism provides, with a predetermined regularity, variations in the pressure of the viscous fluid adjacent the outflow opening. This leads to the occurrence of a disturbance in the fluid jet flowing out of the outflow opening. This disturbance leads to a constriction of the jet which in turn leads to a breaking up of the jet into drops. This yields a continuous flow of egressive drops with a uniform distribution of properties such as dimensions of the drops.

The publication further discloses a second droplet ejection system arranged to generate second droplets for colliding the second droplets into the first droplets so as to selectively deflect the first droplets from a predefined printing trajectory. The second droplet ejection system is of a continuous nature and uses polar fluids to deflect a second stream of droplets into the continuous stream of the first droplet ejection system.

SUMMARY OF THE INVENTION

In one aspect, the invention aims to provide an alternative to the continuous droplet ejection system that is used to deflect the continuous stream of the first droplets. In another aspect, the invention aims to provide an alternative to a deflection mechanism using polar fluids.

DETAILED DESCRIPTION OF THE EMBODIMENTS

According to an aspect of the invention, a droplet collision device is provided comprising a first droplet ejection system arranged to generate a continuous stream of first droplets from a fluid jet ejected out of an outlet channel; and a second droplet ejection system arranged to eject second droplets for colliding the second droplets into the first droplets, the second droplet ejection system comprises a control circuit to selectively eject the second droplet and to have it collided with a predefined first droplet.

According to another aspect of the invention, a method of colliding droplets from a fluid jet ejected from a continuous printer is provided comprising generating a continuous stream of first droplets from a fluid jet; generating second droplets for colliding the second droplets into the first droplets wherein the second droplets are selectively ejected and collided with a predefined first droplet.

Without limitation, droplet frequencies may be in the order of 2-80 kHz, with droplets smaller than 80 micron.

In addition, by virtue of high pressure, fluids may be printed having a particularly high viscosity such as, for instance, viscous fluids having a viscosity of $300 \cdot 10^{-3}$ Pa·s or more when being processed. In particular, the predetermined pressure may be a pressure up to 600 bars.

Figure 1:
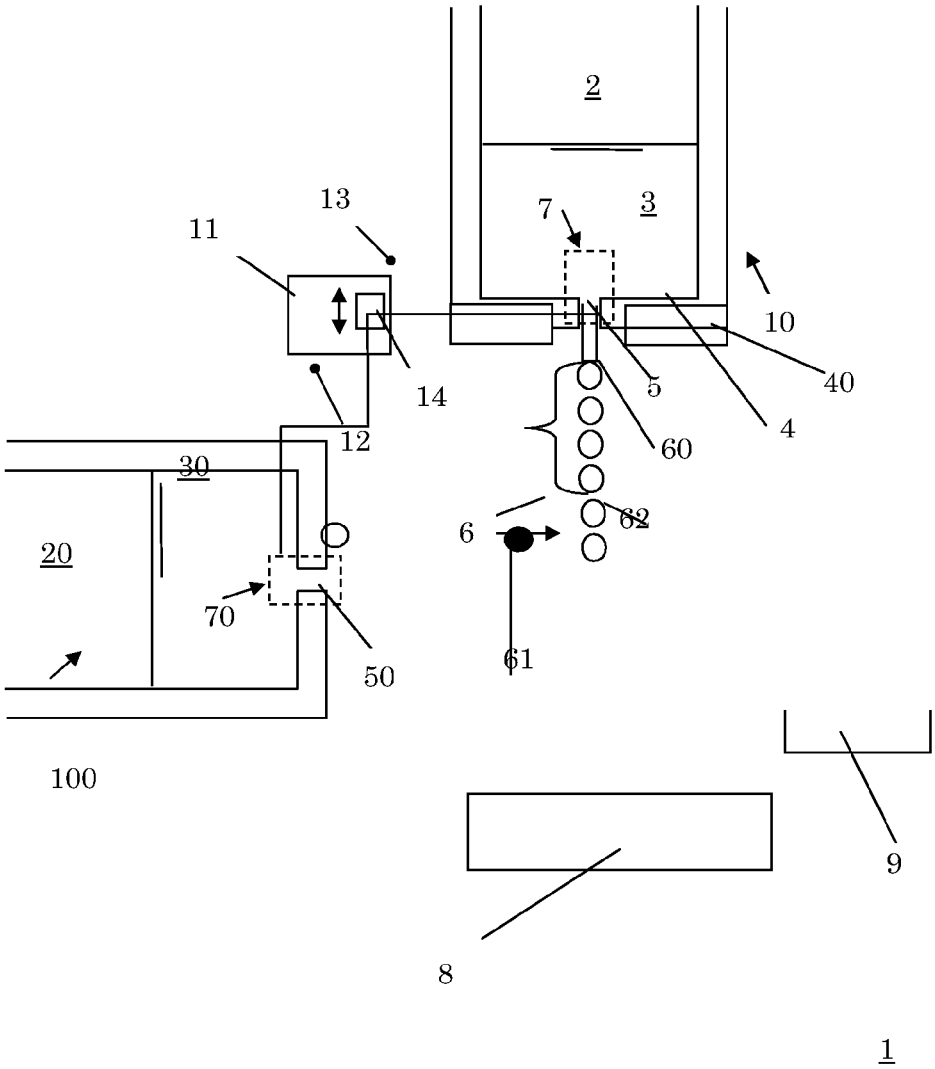
FIG. 1 shows schematically a first embodiment of a printing system for use in the present invention.
Figure 2:
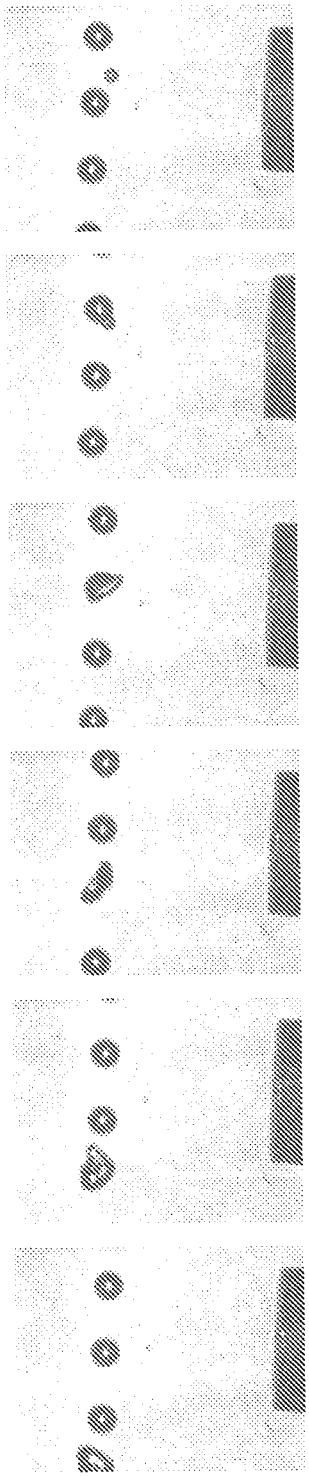
FIG. 2 shows a direct collision resulting in merging of two droplets.

Other features and advantages will be apparent from the description, in conjunction with the annexed drawings, wherein:

FIG. 1 shows schematically a first embodiment of a printing system for use in the present invention;

FIG. 2 shows a direct collision resulting in merging of two droplets; and

Figure 3:
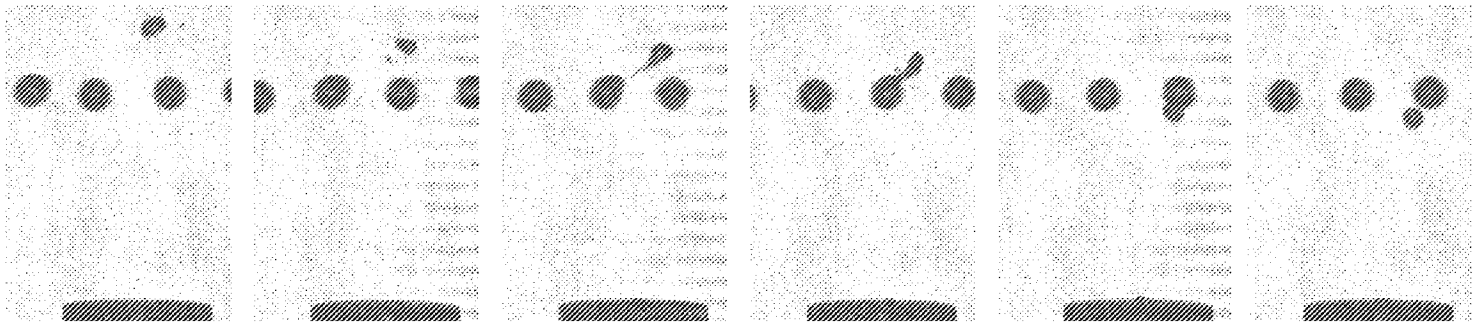
FIG. 3 shows an off-axis collision resulting in bouncing of two droplets.

FIG. 3 shows an off-axis collision resulting in bouncing of two droplets.

FIG. 1 shows a first schematic embodiment of a continuous printer head 1 according to the invention. The print head 1 comprises a first droplet ejection system 10 arranged to generate a continuous stream of first droplets 6 from a fluid jet 60 jetted out of an outlet channel 5. The droplet ejection system 10 comprises a chamber 2, defined by walls 4. Chamber 2 is suited for containing a pressurized liquid 3, for instance pressurized via a pump or via a pressurized supply (not shown). The chamber 2 comprises an outlet channel 5 through which a pressurized fluid jet 60 is jetted out of the channel and breaks up in the form of droplets 6. Schematically shown, actuator 7 is formed near the outlet channel and may be vibrating piezo-electric member. By actuation of the actuator 7, a pressure pulse is formed, breaking up the fluid jet and accordingly forming small monodisperse droplets 6.

The outflow opening 5 is included in a relatively thin nozzle plate 4 which can be a plate manufactured from metal foil, of a thickness of 0.3 mm, for example 0.1-3 mm. The outflow opening 5 in the plate 4 has a diameter of 50 μm in this example. A transverse dimension of the outflow opening 5 can be in the interval of 2-500 μm. As an indication of the size of the pressure regulating range, it may serve as an example that at an average pressure up to 600 bars [$\equiv 600 \times 10^5$ Pa]. The print head 10 may be further provided with a supporting plate 40 which supports the nozzle plate 4, so that it does not collapse under the high pressure in the chamber. Examples of vibrating actuators may be found for example in WO2006/101386 and may comprise a vibrating plunger pin arranged near the outlet channel 5.

In FIG. 1 a second droplet ejection system 100 is arranged that selectively ejects a second droplet 61. The second droplet 61 is directed towards the stream of droplets 6 ejected continuously from the printhead 10 and is directed to a predefined first droplet 62 to have it collided with the second droplet 61 to selectively deflect the first droplet 62 from the predetermined printing trajectory. Thus by colliding the second droplet 61 to the first droplet 62, the first droplet 62 is not received on substrate 8 but for instance in a collection gutter 9. In a preferred embodiment the printing material in collection gutter 9, comprised of a mixture of droplets 61 and 62, is demixed or skimmed to recirculate printing liquid 3 to the printerhead 10 and/or to provide printer liquid 30 to the printhead 100. Generally, the printhead 10 can be identified as a continuous printhead, wherein the printhead 100 can be identified as a drop on demand type printhead. To that end, the second printhead 100, in fluid connection with chamber 20, comprises actuator 70 which is of a type that is known in the art, that is arranged to selectively eject second droplet 61 through outlet channel 50. Control of the actuators 70 is provided by a control circuit 11. The control circuit 11 comprises a signal output 12 to control actuation of actuator 70 and signal input 13 indicative of a droplet generating frequency of the first droplet ejection system 10. In addition control circuit 11 comprises synchronizing circuitry 14 to synchronize a droplet ejection of the second droplet 61 to an ejection frequency of first droplets 6 of the printhead 10. By control circuit 11, droplet 62 can be selectively deflected out of the droplet stream 6 of the printhead 10 on individual basis. In one aspect of the invention a droplet frequency of the printhead 10 is higher than 20 kHz. In particular with such frequencies, a droplet diameter can be below 100 micron, in particular below 50 micron. In addition to a jet speed of 8 m/s or higher, the drop on demand type printhead 100 is particularly suited to select a predefined droplet 62 of continuous stream 6 to have it collided with a second droplet 61. In particular because of the small size of the droplets, conventional electrostatic deflection mechanism are difficult to implement. In view of selected viscosities of jet material 60, which maybe ranging from 300-900 $10^{-3}$ Pa·s., and the fact that they may be formed from an electrical isolating printing material, that is printing material that is non-polar, generated droplets 6 are difficult to deflect by electro magnetic fields. The current inventive principle can provide a suitable alternative, which may be, in comparison with a conventional continuous deflection system, very specific to individual droplets. For instance, for individual droplets 62 of a continuous stream of droplets 6, the local speed differences of the droplets can be accounted for, for example a speed difference resulting from an effect that a first droplet of a continuous stream is ejected with different speeds. This effect may arise due to frictional effects of the surrounding ambient atmosphere. Accordingly a high dynamic range can be obtained by the deflection method according to the inventive embodiment. In one aspect the first droplets are therefore of a high viscosity and of an isolating printing material, or a printing material with low electrical conductivity, below 500 mS/cm. In that respect the nature of the second droplets can be of another viscosity, typically of a viscosity that is normal for ordinary printing purposes, that is, a viscosity well below 300 mPa·s. With the arrangement disclosed in FIG. 1 a method can be provided for selecting droplets from a fluidjet 60 ejected from a continuous printerhead. The droplets can be used for many purposes including image printing, rapid manufacturing, medical appliances and polymer electronics. In particular, the method is suited for printing fluids that fail to respond to electrostatic or electrodynamic deflection methods. Accordingly, for a continuous stream of first droplets 6 from a fluid jet 60, a deflection method is provided by a generating a second droplet 61 to have it collided to a selected first droplet have a predefined printing trajectory. The ejection of the second droplet is individually and selectively arranged to collide with to a predefined one of many droplets 6 from a continuous stream of droplets 60.

In one aspect, deflection by impulse transfer can be used to selectively deflect the first droplets from a predefined printing trajectory towards a print substrate 8.

Alternatively, as shown in the micrograph of FIG. 2, the droplet collision method can be used merge second droplets 61 with first droplets 62, for example, to selectively change the properties of the droplet 62 from the first jet 60 in order to obtain a predetermined printing behavior. For example, this could be e.g. changing temperature, or changing the chemical properties by mixing.

With respect to the FIG. 3 embodiment, a droplet bounce is shown, by colliding first and second droplets in an off-axis collision. In this case, no mixing occurs and first and second droplets merely bounce from each other, and can be collected separately (FIG. 3). This special case will allow simple recycling of the possible different materials.

In addition, by bouncing or colliding droplets, special forms of encapsulated droplets can be provided, in particular, by multiple collisions. For example two droplet ejection systems can be provided oppositely arranged respective to a continuous stream of first droplets, for selectively ejecting second droplets towards the continuous stream. In this way, special droplet compositions can be provided, for example, a droplet having a hydrophile and a hydrophobe side, or a droplet having multiple colored sides, for example, a black and a white side or a droplet having red, green and blue sides.

The invention has been described on the basis of an exemplary embodiment, but is not in any way limited to this embodiment. Diverse variations also falling within the scope of the invention are possible. To be considered, for instance, are the provision of regulable heating element for heating the viscous printing liquid in the channel, for instance, in a temperature range of 15-1300° C. By regulating the temperature of the fluid, the fluid can acquire a particular viscosity for the purpose of processing (printing). This makes it possible to print viscous fluids such as different kinds of plastic and also metals (such as solder).

What is claimed is:

1. A droplet collision device, comprising:

a first droplet ejection system configured to generate a continuous stream of first droplets from a fluid jet ejected out of an outlet channel; and a second droplet ejection system configured to eject second droplets for colliding the second droplets into the first droplets, wherein the second droplet ejection system is a drop-on-demand type system comprising an actuator and a control circuit, wherein the control unit comprises synchronizing circuitry configured to synchronize a droplet ejection of the second droplet to a droplet generating frequency of the first droplets, and a signal output configured to control the actuator to selectively eject the second droplets to be collided with predefined droplets among the first droplets.

2. A droplet collision device according to claim 1, wherein the control circuit is configured to selectively deflect the predefined first droplets from a predefined printing trajectory towards a print substrate.

3. A droplet collision device according to claim 1, wherein the control circuit comprises signal inputs indicative of a droplet generating frequency of the first droplet ejection system.

4. A droplet collision device according to claim 1, wherein the outlet channel is in the interval of 2-500 micron.

5. A droplet collision device according to claim 1, wherein the outlet channel length is in the interval of 0.1-3 millimeter.

6. A droplet collision device according to claim 1, wherein the outlet channel is in the interval of 5-250 micron.

7. A droplet collision device according to claim 1, wherein the outlet channel is in the interval of 5-100 micron.

8. A droplet collision device, comprising:

a first droplet ejection system configured to generate a continuous stream of first droplets from a fluid jet ejected out of an outlet channel;

a second droplet ejection system configured to eject second droplets for colliding the second droplets into the first droplets; and a temperature controller, which is configured to control the temperature of said second droplets, so as to change the temperature of the first droplets by colliding said second droplets, wherein the second droplet ejection system comprises a control circuit to selectively eject the second droplet and to have it collided with a predefined first droplet.

9. A method of colliding droplets, comprising:

generating a continuous stream of first droplets from a fluid jet; and generating second droplets for colliding the second droplets into the first droplets;

wherein the second droplets are selectively ejected from a drop-on-demand type system and collided with predefined droplets among the first droplets, wherein the drop-on-demand type system comprises an actuator and a control circuit, wherein the control circuit configured to synchronize a droplet ejection of the second droplet to a droplet generating frequency of the first droplets, wherein the control circuit provides an output signal for controlling the actuator for selectively ejecting the second droplets.

10. A droplet collision method according to claim 9 wherein said first and second droplets are collided so as to selectively deflect the predefined first droplets from a predefined printing trajectory.

11. A method according to claim 9, wherein the first and second droplets are formed from an isolating printing material or a printing material with low electrical conductivity, below 500 mS/cm.

12. A method according to claim 9, wherein the first droplets are of a material having a viscosity up to 900·mPa·s.

13. A droplet collision method according to claim 9, wherein the first droplets are of a material having a viscosity ranging between $300\text{-}900\cdot10^{-3}$ Pa·s and wherein the second droplets are of a material having a viscosity lower than $300\cdot10^{-3}$ Pa·s.

14. A method according to claim 13, wherein collided droplets are received and demixed.

15. A method according to claim 9, wherein a droplet frequency of the continuous stream is higher than 2 kHz.

16. A method according to claim 9, wherein a droplet frequency of the continuous stream is in the range of 5-150 kHz.

17. A method according to claim 9, wherein a droplet frequency of the continuous stream is in the range of 10-70 kHz.

18. A method of colliding droplets from a fluid jet ejected from a continuous printer, comprising:

generating a continuous stream of first droplets from a fluid jet; and generating second droplets for colliding the second droplets into the first droplets;

wherein the second droplets are selectively ejected and collided with a predefined first droplet, wherein said first and second droplets are collided off-axis to result in bouncing of said first and second droplets.

19. A method according to claim 18 whereby these first and second droplets are separately returned for recycling.

* * * * *

UNITED STATES PATENT AND TRADEMARK OFFICE

CERTIFICATE OF CORRECTION

PATENT NO. : 8,544,974 B2
APPLICATION NO. : 12/742236
DATED : October 1, 2013
INVENTOR(S) : Boot et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 623 days.

Signed and Sealed this
Twentieth Day of January, 2015

Michelle K. Lee

Michelle K. Lee
*Deputy Director of the United States Patent and Trademark Office*